United States Patent [19]

Hass et al.

[11] Patent Number: 4,936,798

[45] Date of Patent: Jun. 26, 1990

[54] ELECTRICAL CONNECTOR

[75] Inventors: Juergen Hass, Erzhausen; Gheorghe Hotea, Griesheim; Peter K. Kircher, Dietzenbach, all of Fed. Rep. of Germany

[73] Assignee: AMP Incorporated, Harrisburg, Pa.

[21] Appl. No.: 381,225

[22] Filed: Jul. 17, 1989

[51] Int. Cl.[5] ..... H01R 13/436

[52] U.S. Cl. ..... 439/752; 439/869

[58] Field of Search ..... 439/733, 752, 869

[56] References Cited

U.S. PATENT DOCUMENTS

| | | | |
|---|---|---|---|
| 3,573,720 | 4/1971 | Reynolds | 339/217 |
| 4,113,333 | 9/1978 | Horowitz | 439/752 |
| 4,698,030 | 10/1987 | Ryll et al. | 439/752 |

FOREIGN PATENT DOCUMENTS

| | | | |
|---|---|---|---|
| 206722 | 12/1986 | European Pat. Off. . | |
| 86/05630 | 9/1986 | PCT Int'l Appl. . | |
| 533310 | 2/1941 | United Kingdom | 439/733 |

*Primary Examiner*—Gary F. Paumen

*Attorney, Agent, or Firm*—Bruce Wolstoncroft

[57] ABSTRACT

The housing, which is of circular cross section, defines a series of spaced, terminal-receiving cavities arranged in a ring about the axis of the housing. An annular terminal retainer is received in an annular recess in the housing, at the outer periphery of a ring of terminal cavities. The retainer is provided with radially inwardly projecting terminal retaining members. The retainer ring can be moved between a first position, in which the terminal-retaining members are clear of the cavities, to allow terminals to be inserted into the cavities and a second angular position in which each retaining member intersects a respective cavity to overlie a collar on the respective terminal therein so that it is locked in its cavity.

10 Claims, 14 Drawing Sheets

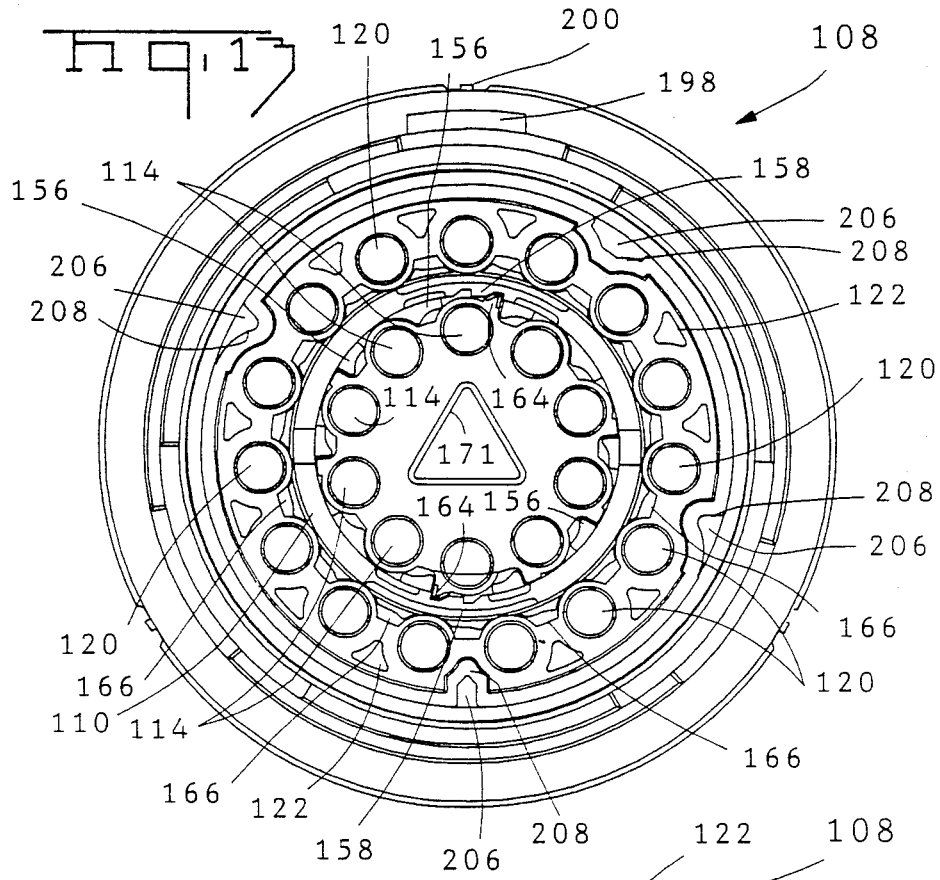
120
156
200
108
198
156
114
158
206
208
206
208
122
120
114
164
171
164
156
208
206
166
120
166
110
114
120
166
166
122
158
206
208
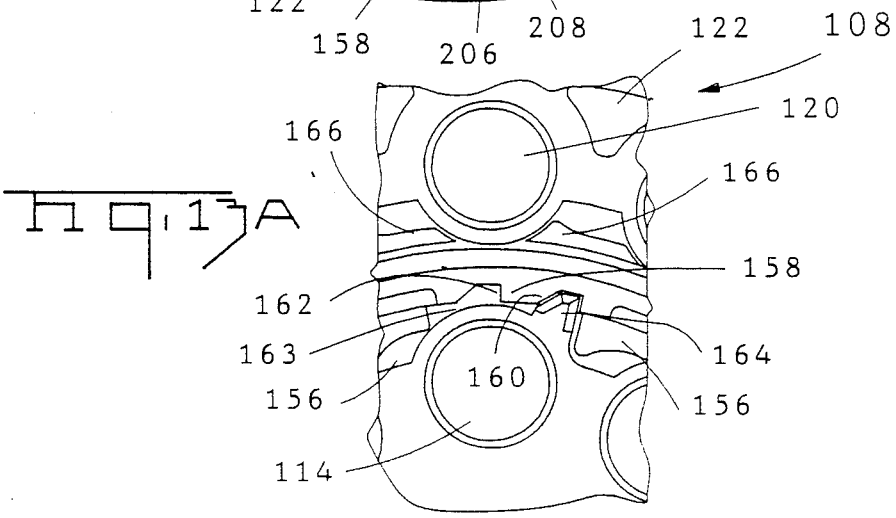
122
108
120
166
166
158
162
163
160
164
156
156
114

ELECTRICAL CONNECTOR

BACKGROUND OF THE INVENTION

1. Field of the Invention

This invention relates to an electrical connector insulating housing and to an electrical connector comprising such a housing.

2. Description of the Prior Art

There is disclosed in DE-U-8508465.4 an electrical connector insulating housing defining a series of spaced, terminal receiving cavities arranged in a ring about an axis of the housing, the housing receiving a terminal retainer for angular displacement about said axis between a first angular position to allow electrical terminals to be inserted into the cavities and a second angular position to overlie abutments on the terminals when they have been inserted in the cavities to lock the terminals therein.

The use of such a terminal retainer to lock the terminals in their cavities in an electrical connector housing has the advantage that reliance is not placed upon latching tongues on the terminals themselves to retain the terminals in their cavities. Such latching tongues tend to be insufficiently robust to prevent the terminals from backing out from their cavities under the action of vibration, especially where the housing is sited in a motor vehicle, for example, or if undue tension is applied to leads connected to the terminals. Also, the latching tongues are susceptible to damage when the terminals are being handled prior to their insertion into the cavities.

In the housing of DE-U-8508465.4, the terminal retainer is received in a hood projecting from the housing and is in the form of a circular cross section block which presents a terminal receiving face of the housing. Since the terminal retainer must be angularly displaceable in the hood and cannot therefore be sealed thereto effectively, it is impracticable to seal the connector against the ingress of moisture by means of sealing grommets in the cavities.

SUMMARY OF THE INVENTION

According to one aspect of the present invention an electrical connector insulating housing as defined in the second paragraph of this specification, is characterized in that terminal retainer is annular and surrounds the ring of cavities, the terminal retainer having radially inwardly directed terminal retaining members which intersect the cavities in the second angular position of the terminal retainer to overlie said abutments, locking the terminals in their cavities.

Thus, the terminals can be provided with sealing grommets and a sealing ring may be provided so that when the connector is mated with a mating sealed connector, the assembly so formed is sealed against the ingress of moisture.

The cavities may be defined by individual tubular walls each having an opening for receiving one of the terminal retaining members. Thus, the tubular walls, each of which is preferably of circular cross section, may serve to guide the terminal retaining member in cooperation with an internal wall of a hood surrounding the terminal retainer. The terminals may be latched in their cavities, before the terminal retainer is moved to its second angular position by means of locking tongues on the terminals which engage with shoulders in the cavities.

The housing may define a series of spaced, further terminal receiving cavities surrounding the ring of cavities, the terminal retainer being disposed between said further cavities and the cavities of the ring of cavities. In this case the terminal retainer is provided with outwardly directed terminal retaining further members which intersect the further cavities in the second position of the terminal retainer to overlie abutments on further terminals when they have been inserted into the further cavities, to lock the further terminals therein.

Since the terminal retainer is disposed within the housing, the outer periphery of the housing is left free and so may be formed with keying means or coupling means for cooperation with complimentary means on a mating electrical connector housing.

The terminal retainer may be latched in its first and second angular positions, by means for example of a radially inwardly directed tooth on the terminal retainer and a resilient spur projecting radially outwardly from a wall of a recess in the housing, which recess receives the terminal retainer. The spur may be engageable with a cam surface on one side of the tooth in the first angular position of the terminal retaining member so that as the terminal retaining member is moved towards its second angular position, the resilient spur is cammed over the tooth to lodge against a shoulder on the opposite side of the tooth on the second angular position of the terminal retainer, whereby the terminal retainer is locked in its second angular position. Thus, once the terminal retainer has been moved to its second position, it cannot be dislodged therefrom even under the action of the most sever vibration.

According to another aspect of the present invention, an electrical connector comprises an insulating housing defining a series of spaced terminal receiving cavities arranged in a ring about an axis of the housing and opening into opposite terminal receiving, and mating, end faces thereof, an elongate electrical terminal in each cavity having an electrical lead terminated thereto at one end of the terminal proximate to said terminal receiving face, the terminal having a mating portion at its other end, and intermediate the mating portion and the lead an abutment extending radially of said axis, the housing receiving a terminal retainer for angular displacement about said axis, between a first angular position out of register with the abutments and a second angular position in overlying relationship therewith, to prevent withdrawal of the terminals from the cavities by way of the terminal receiving face; is characterized in that the terminal retainer is annular and surrounds the ring of cavities, the terminal retainer having radially inwardly directed terminal retaining members which intersect the cavities in the second angular position of the terminal retainer, to overlie the abutments so that each abutment projects between the respective terminal retaining member and a stop in the housing between the terminal retaining member and the mating face, each electrical lead being surrounded by a sealing grommet engaging the wall of the respective cavity in sealing tight relationship proximate to the terminal receiving face.

BRIEF DESCRIPTION OF THE DRAWINGS

FIG. 3 is a front view of the housing as shown in FIG. 1, but with no terminal therein;

FIG. 13 is a full end view of the pin housing taken on the lines 13—13 of FIG. 15, but in which electrical pin terminals shown in FIG. 15 are omitted;

FIG. 13*a* is an enlarged fragmentary view illustrating details of FIG. 13;

DETAILED DESCRIPTION OF THE PREFERRED EMBODIMENT

Figure 4:
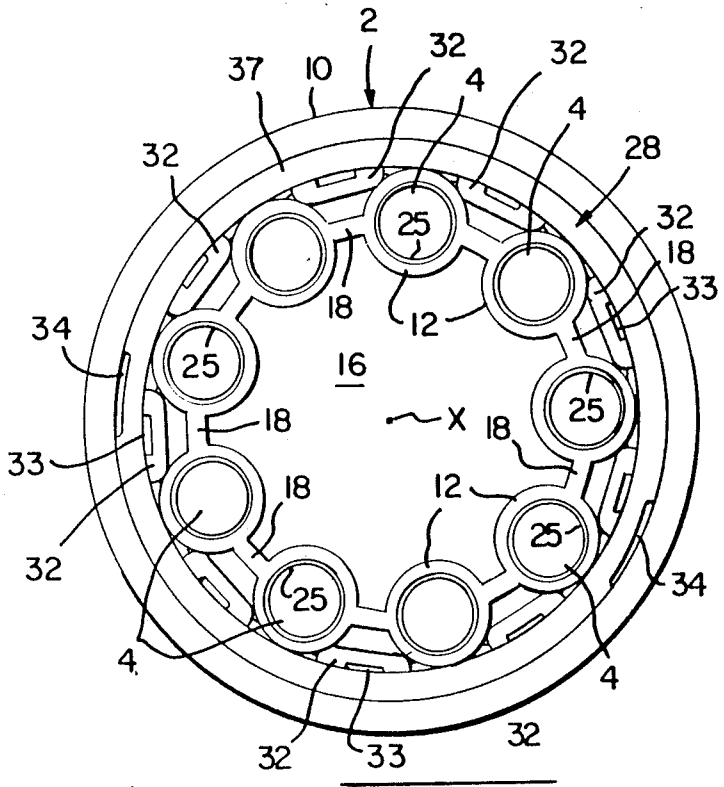
FIG. 4 is a similar view to that of FIG. 3 but showing the terminal retainer in a terminal-admitting position.

The connector comprises a circular cross section insulating housing 2 defining a series of nine spaced terminal-receiving cavities 4 arranged in a ring about the axis X—X of the housing 2 as shown in FIGS. 3 and 4. Each cavity 4, which extends axially of the housing 2, opens into a terminal-receiving rear end face 6 and a mating forward end face 8, thereof. A circular, cross section hood 10 projects from the housing 2, beyond the mating face 8. Within the hood 10, each cavity 4 is defined by an individual, circular cross section tubular wall 12, formed integrally with a wall 16 in the housing 2, which is perpendicular to the axis X—X. Back from the wall 12, the cavity 4 is defined by the outer peripheral wall of the housing 2 and by individual cavity walls 14 also formed integrally with the wall 16. The individual walls 12 are interconnected by webs 18 arranged in a ring about the axis X—X. Within each cavity 4, the walls 12 and 14 cooperate to define an annular stop shoulder 20, shown in FIG. 1. The hood 10 and the walls 12 cooperate to define an annular guideway 22, within which are axially spaced and opposed guide shoulders 24 and 26, respectively, the latter being annular. The interior of each wall 12 is formed with a forwardly facing, annular latching shoulder 25. There is received in the guideway 22, an annular terminal retainer in the form of an axially elongate circular retainer ring 28, for angular displacement about the axis X—X. The ring 28 has a radially inwardly projecting, internal, annular bead 30 which overlies the shoulder 24, and nine constantly peripherally spaced terminal-retaining members 32 which protrude radially inwardly of the retainer ring 28, beyond the lugs 30, each member 32 having a rearwardly opening axial recess 33 and bevelled corners 35 (FIG. 2). Since the end 31 of the retainer ring 28, nearest to the face 6, that is to say its rear end, overlies the shoulder 26 and since the bead 30 overlies the shoulders 24, the retainer ring 28 is held captive in the guideway 22, and is guided thereby in its angular movement about the axis X—X. As shown in FIGS. 3 and 4, the forward end 37 of the retainer ring 28 is formed with a pair of tool receiving recesses 34. Between the shoulders 20 and 26, the radially outer part of each wall 12 has an arcuate opening 38 by way of which the guideway 22 and the cavity 4 communicate.

In a terminal admitting, first angular position of the retainer ring 28 (FIG. 4), each terminal-retaining member 32 lies between a pair of adjacent walls 12 and thus beyond the openings 38 therein. When the retainer ring 28 is angularly displaced by approximately 20 degrees in either sense from its first angular position, each member 32 is received in a respective opening 38, as shown in FIGS. 1 and 3, the retainer 28 then being in a terminal-locking, second angular position.

Figure 1:
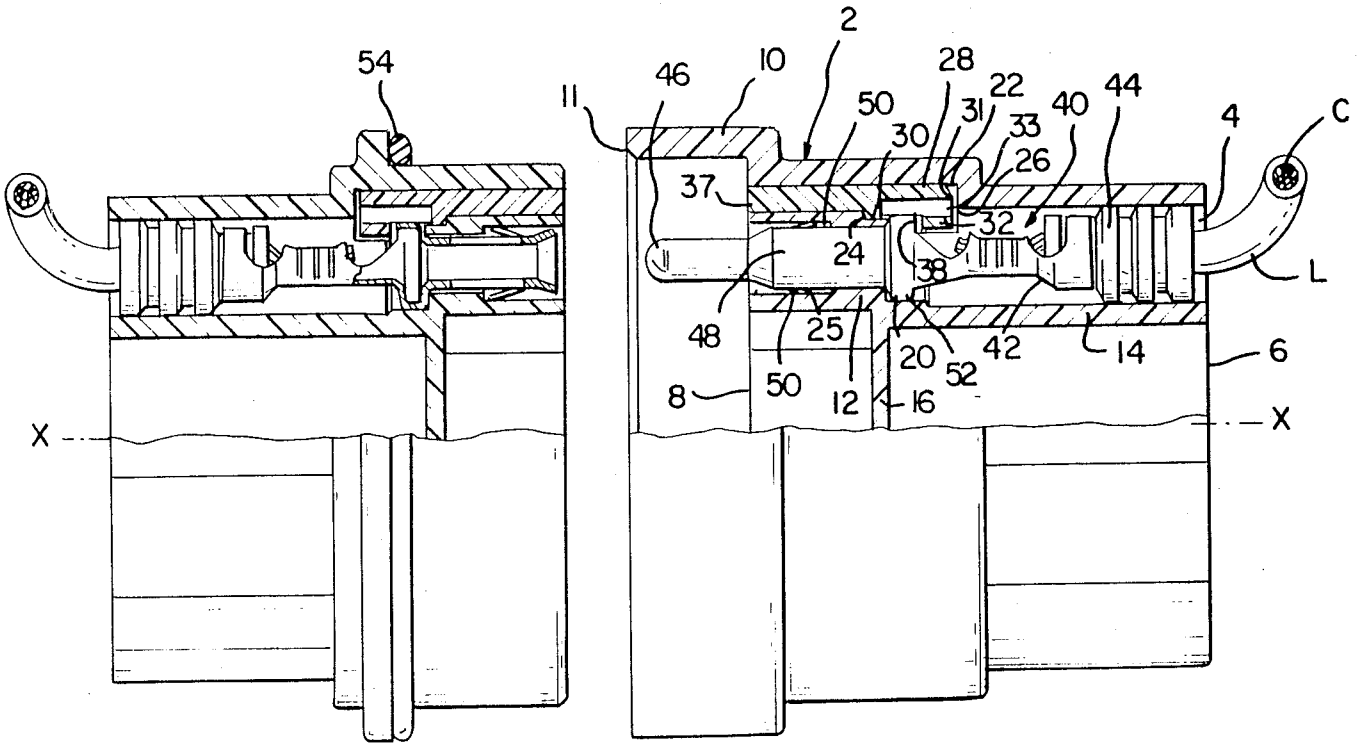
FIG. 1 is a partial axial sectional view of a circular cross section, sealed electrical connector insulating housing and shows an electrical terminal therein, a terminal retainer in the connector being shown in a terminal-locking position.
Figure 2:
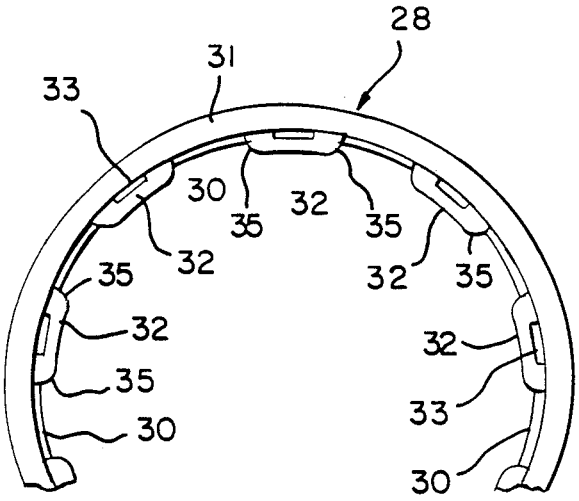
FIG. 2 is a fragmentary, rear view of the terminal retainer.

Electrical terminals 40, one of which is shown in FIG. 1, each for reception in one of the cavities 4, each comprises a crimping ferrule portion 42 at one end, which has been crimped to the stripped electrically conductive core C of an insulated electrical lead L and also about a corrugated sealing grommet 44 which surrounds the insulation of the lead L. At its end remote from the ferrule portion 42, the terminal 40 is formed with a mating portion 46, in this example in the form of a plug for mating with an electrical receptacle (not shown). Between the portions 42 and 46, each terminal 40 has a transition portion 48 from which opposed, resilient, latching tongues 50 have been struck and which terminates adjacent to the ferrule portion 42, in the radially projecting, circular, abutment collar 52.

In order to load the housing 2 with terminals 4, the retainer ring 28 is placed in its first angular (FIG. 4) by inserting prongs of a suitable tool (not shown) through the hood 10 and into the recesses 34 and then rotating the tool to adjust the ring 28 into said first position. A terminal 40 is then inserted into each of the cavities 4, by way of the terminal-receiving face 6, with the mating portion 46 leading, until the collar 52 abuts the shoulder 20 preventing further insertion of the terminal 40. During the insertion of each terminal 40, the tongues 50 latch behind the shoulder 25 in the cavity 4 so that the terminal 40 is retained in its cavity 4, although in the absence of the terminal locking means described herein, it could back out from its cavity 4, when the connector is in use, under the action of vibration, or tensioning of the lead L. Each inserted terminal is latched in its cavity, by the tongues 50, whilst the housing 2 is manipulated during the insertion of the remaining terminals 40 into their cavities 4. In the inserted position of each terminal 40, the mating portion 46 thereof projects beyond the mating face 8, into the hood 10, the collar 52 projects into the opening 38, and the grommet 44 engages in sealing tight fashion with the wall of the cavity 4, proximate to the face 6. In order to lock the inserted terminals 40 in their cavities 4, against the action of said vibration or tensioning, the terminal retainer ring 28 is displaced by means of the tool, from its first angular (FIG. 4) position into its terminal locking, second position (FIGS. 1 and 3), whereby each terminal locking member 32 enters the respective opening 38, guided by its bevelled corners 35, so as to overlie the collar 52 of the respective terminal 40 whereby the terminal 40 is prevented from backing out of its cavity 4. The recesses 33 in the retaining members 32 allow for tolerances in the dimensions of the collars 52. An interfacial seal 54 is positioned on the front shoulder of the mating connector for engagement with the lip 11. The connector 2 can accordingly be mated with a sealed socket connector (not shown) so that the assembly so formed is sealed against the ingress of moisture thereinto.

Figure 6:
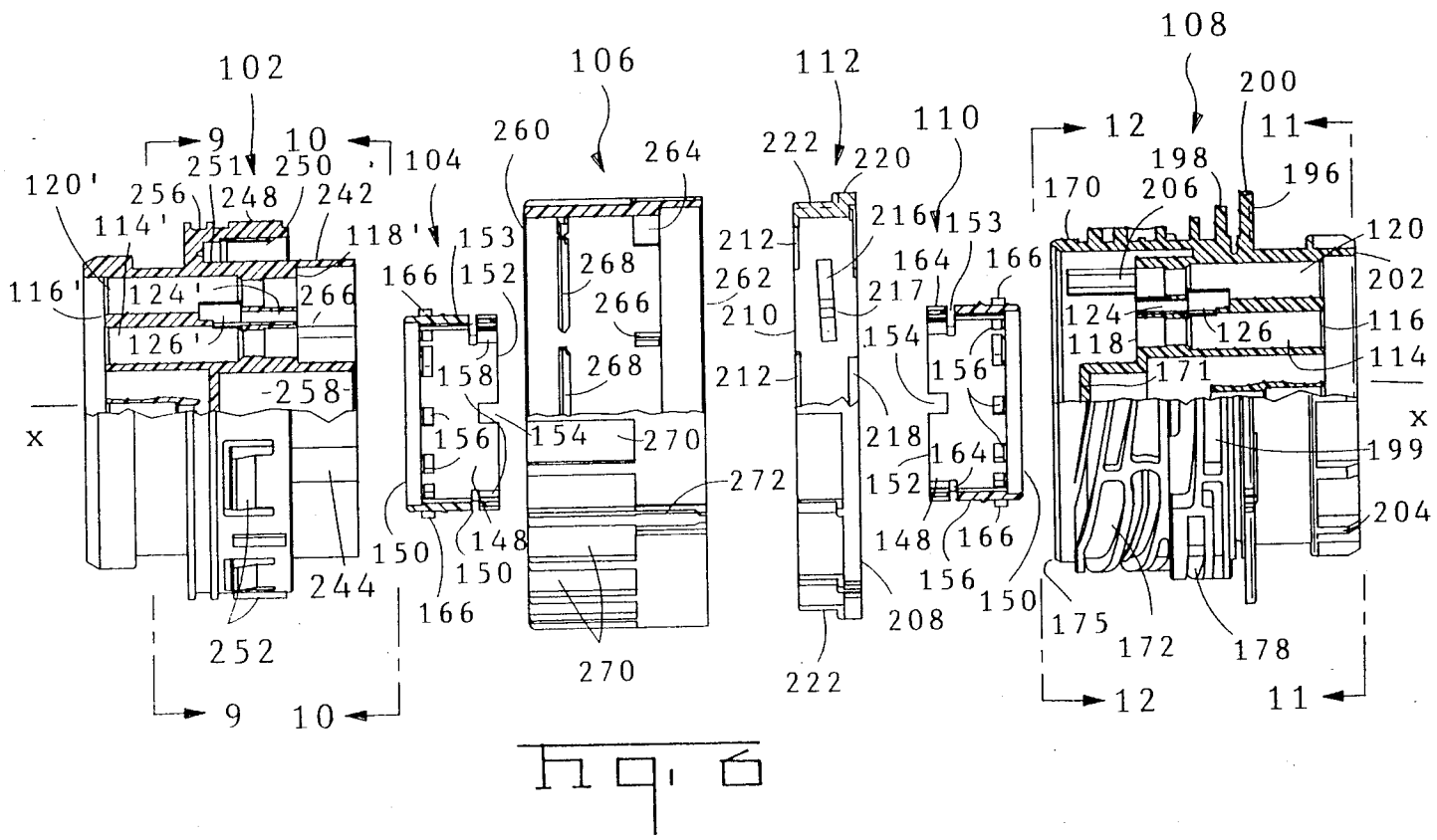
FIG. 6 is an exploded elevational view shown partly in axial section, a pair of mating pin and socket electrical connector housings, each comprising a terminal retainer.
Figure 7:
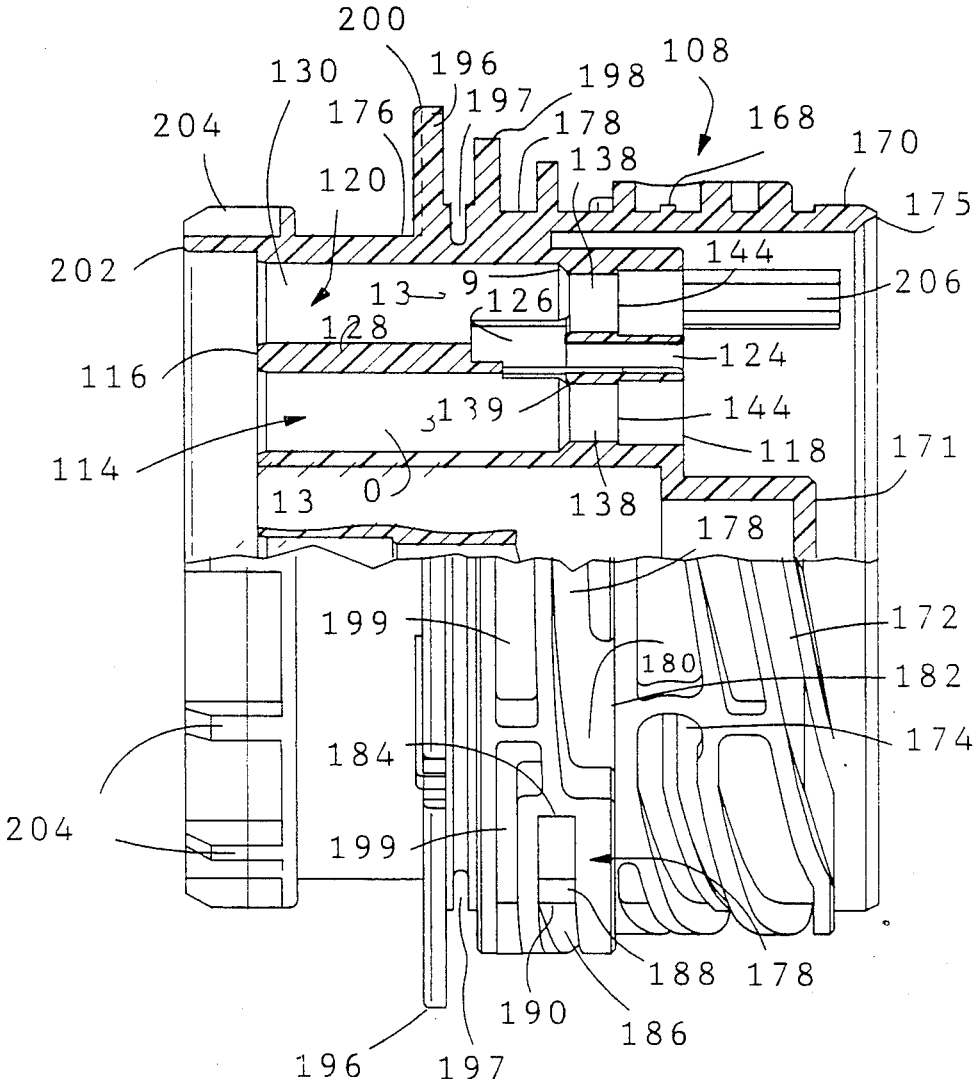

With reference now to FIGS. 6–16, a second embodiment of connector is shown. As shown in FIG. 6, an electrical socket connector housing 102, comprises for assembly thereto, a terminal retainer 104 and a connecting ring 106. FIG. 6 also shows, for mating with the housing 102, an electrical pin connector housing 108 comprising for assembly thereto, a terminal retainer 110 identical with the terminal retainer 104, and panel mounting ring 112. Each of the parts shown in FIG. 6 was molded in one piece from an insulating material and is of overall circular cross-section.

Those parts of the housing 108 which are similar to, or are identical with, corresponding parts of the housing 102 will now be described. The corresponding parts of the housing 102 are similarly referenced to those of the housing 108 but with the addition of a prime symbol.

Figure 11:
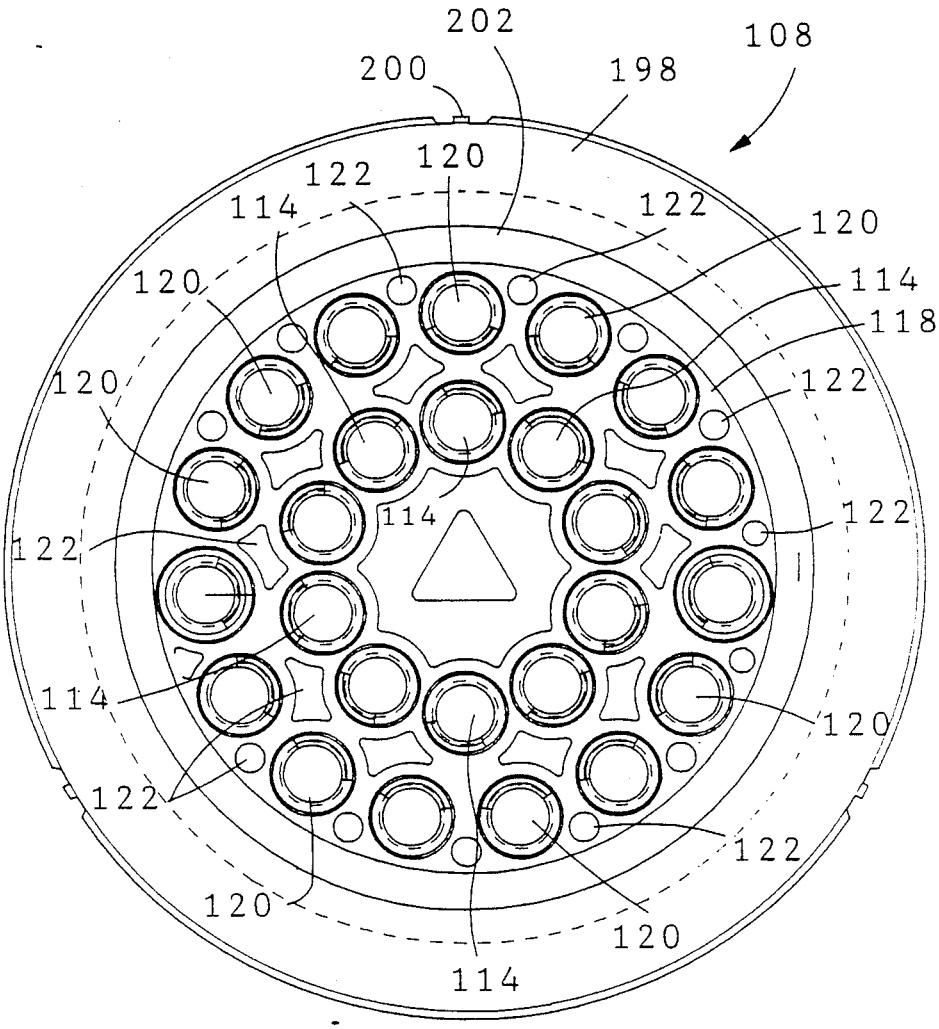
Figure 12:
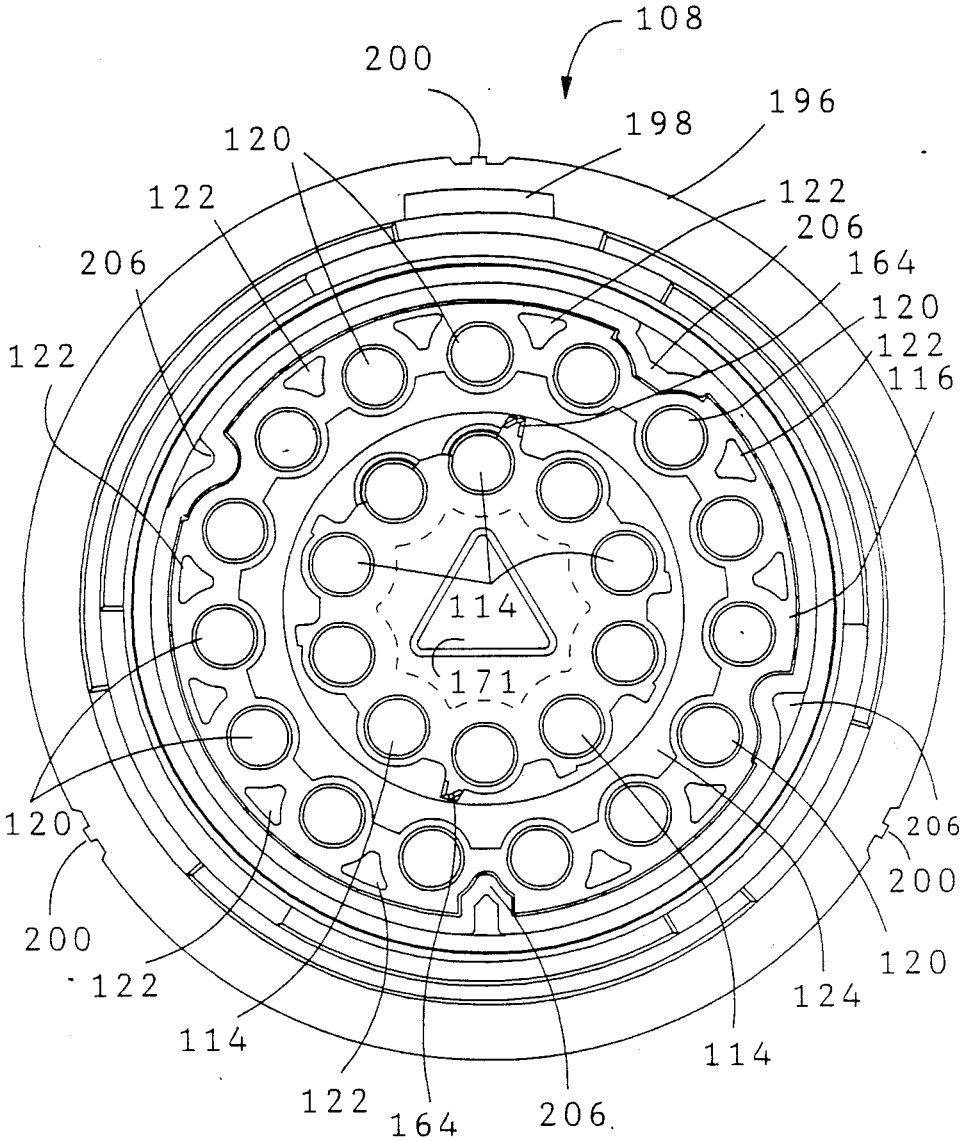

The housing 108 defines a series of ten spaced, terminal receiving through cavities 114 arranged in an inner ring concentric with the axis X—X of the housing 108 as best seen in FIGS. 11 and 12 and each opening into a terminal receiving rear face 116 of the housing 108 and a mating front face 118 thereof. The housing 108 also defines a series of fifteen spaced terminal receiving through cavities 120 arranged in a second and outer ring, concentric with the axis X—X and with the ring of cavities 114, each cavity 120 also opening into the faces 116 and 118. Between the cavities 114 and 120, blind holes 122 of various shapes and sizes were formed the faces 116 and 118 during the molding of the housing 108 to provide relief for warpage of the material from which the housing was molded as the material cooled after the molding operation.

Figure 7:
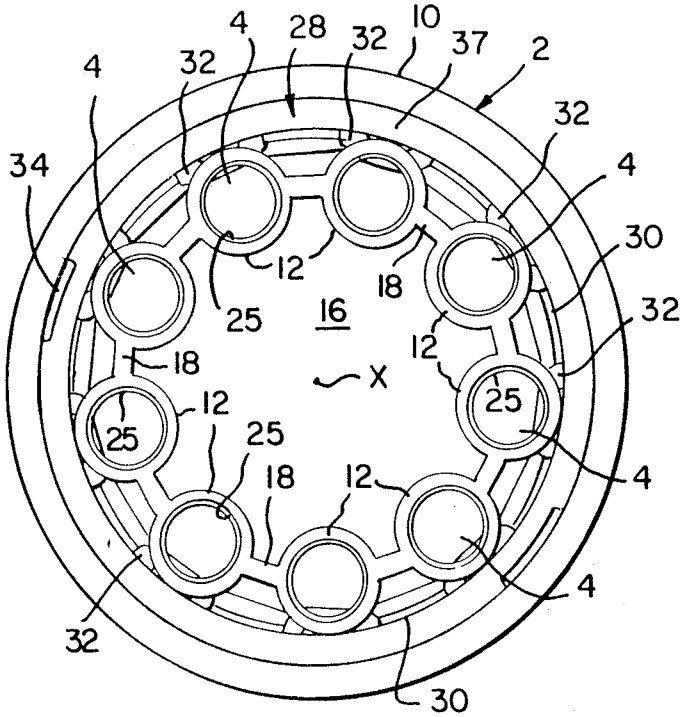
FIG. 7 is an enlarged view of the pin connector housing as shown in FIG. 6.
Figure 5:
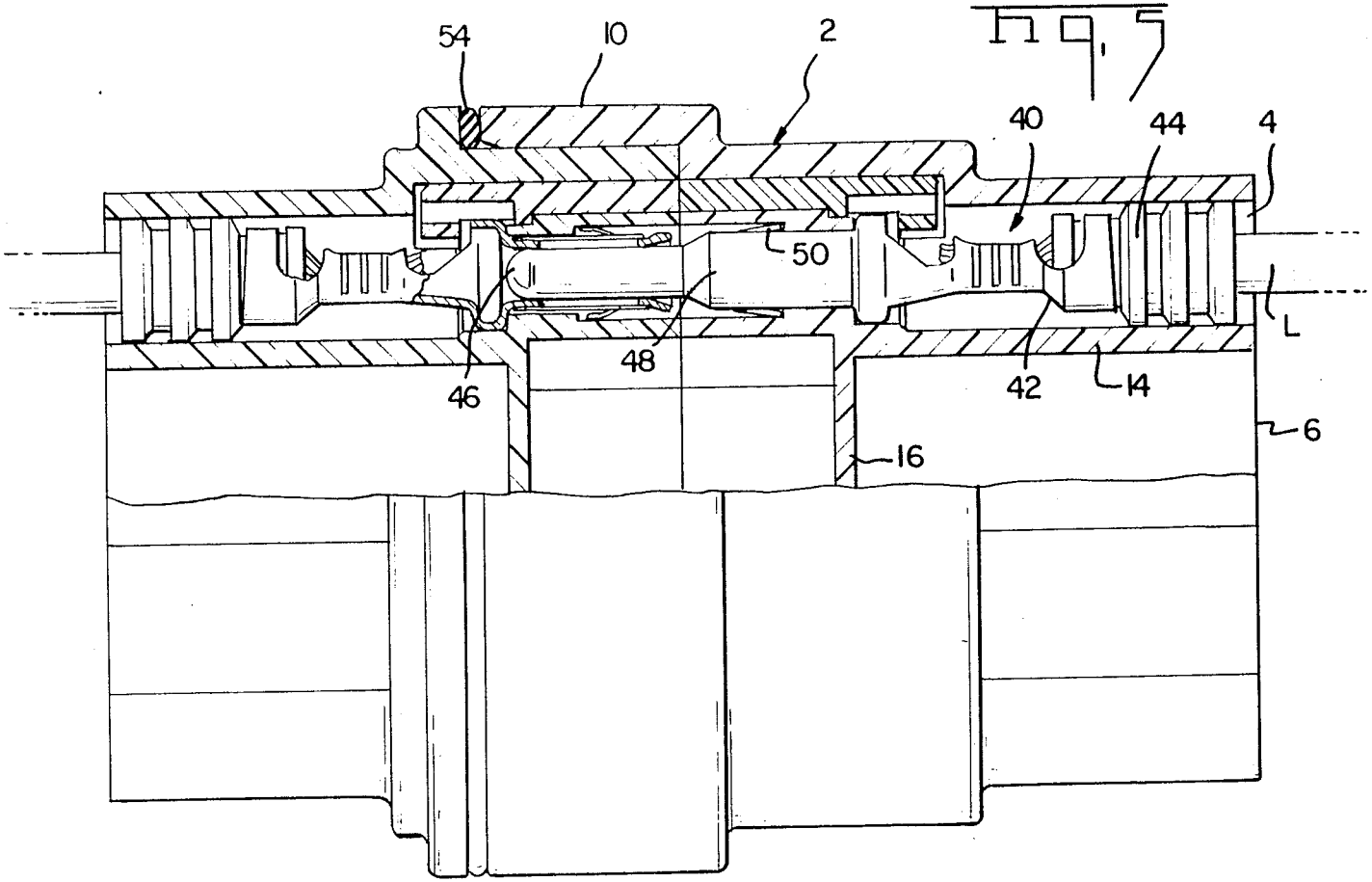
FIG. 5 is a view similar to FIG. 1 showing the two connectors in mating engagement.
Figure 15:
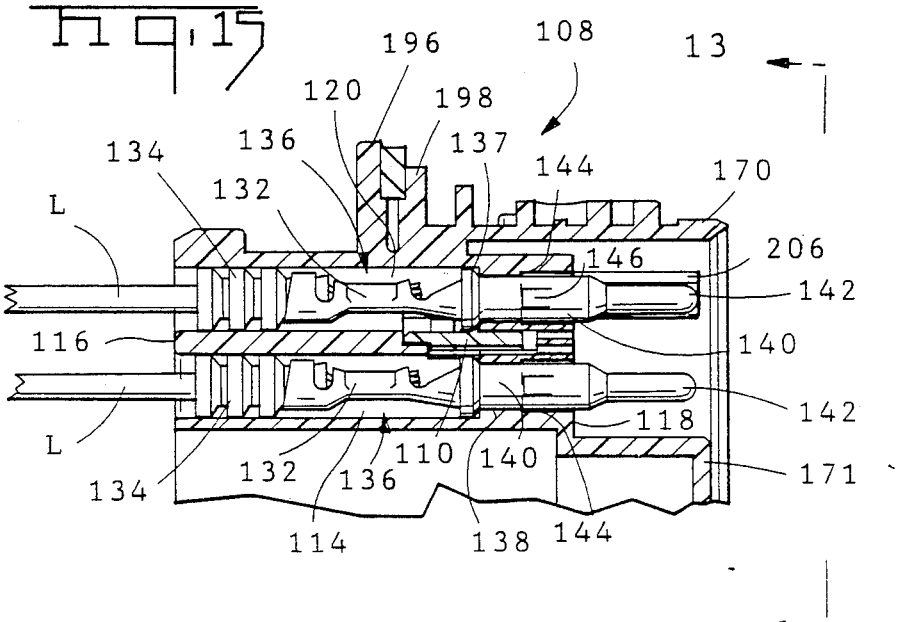
FIG. 15 is a partial longitudinal sectional view of the pin housing showing electrical pin terminals therein and the terminal retainer in a terminal insertion position.
Figure 16:
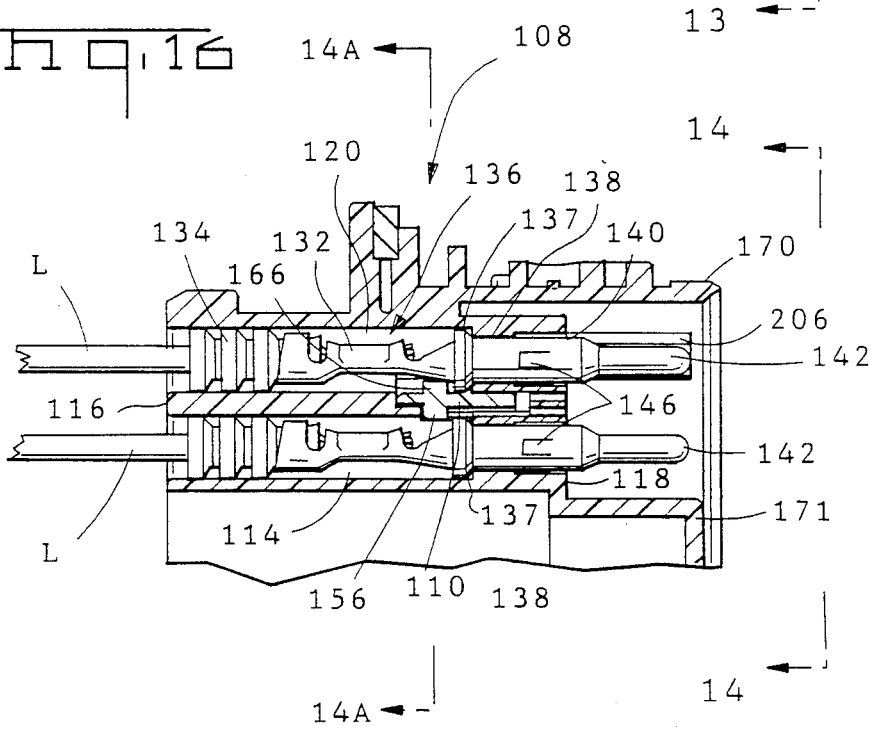
FIG. 16 is a similar view to that of FIG. 15 but showing the terminal retainer in a terminal locking position.

As best seen in FIGS. 7 and 12 the housing 108 defines an annular recess 124 concentric with, and disposed between, the two rows of cavities 114 and 120 for receiving the terminal retainer 110. As best seen in FIG. 7, the recess 124 communicates with an annular opening 126 in an annular wall 128 which separates the cavities 114 from the cavities 120. The opening 126 thus places the cavities 114 and 120 in communication by way thereof. Each cavity 114 and 120 has a larger cross-section part 130 for receiving a crimping ferrule 132 crimped to a lead L, and a sealing grommet 134, of an electrical terminal 136 and a smaller cross-section part 138 for receiving a mounting portion 140 of the terminal 136, from which extends a mating portion 142 in the form of an electrical pin, as shown in FIGS. 15 and 16. The part 130 of each cavity opens into the terminal receiving face 116, the part 138, opening into the mating face 118. There is defined in the part 138 of each cavity 114 and 120, an annular shoulder 144 for engagement by a resilient latching tongue 146 struck from the mounting portion 140 of the respective terminal 136. Between the parts 130 and 138 of each cavity is a shoulder 139 for engagement by an abutment flange 137 surrounding the mounting portion 140 of the terminal 136.

Figure 14:
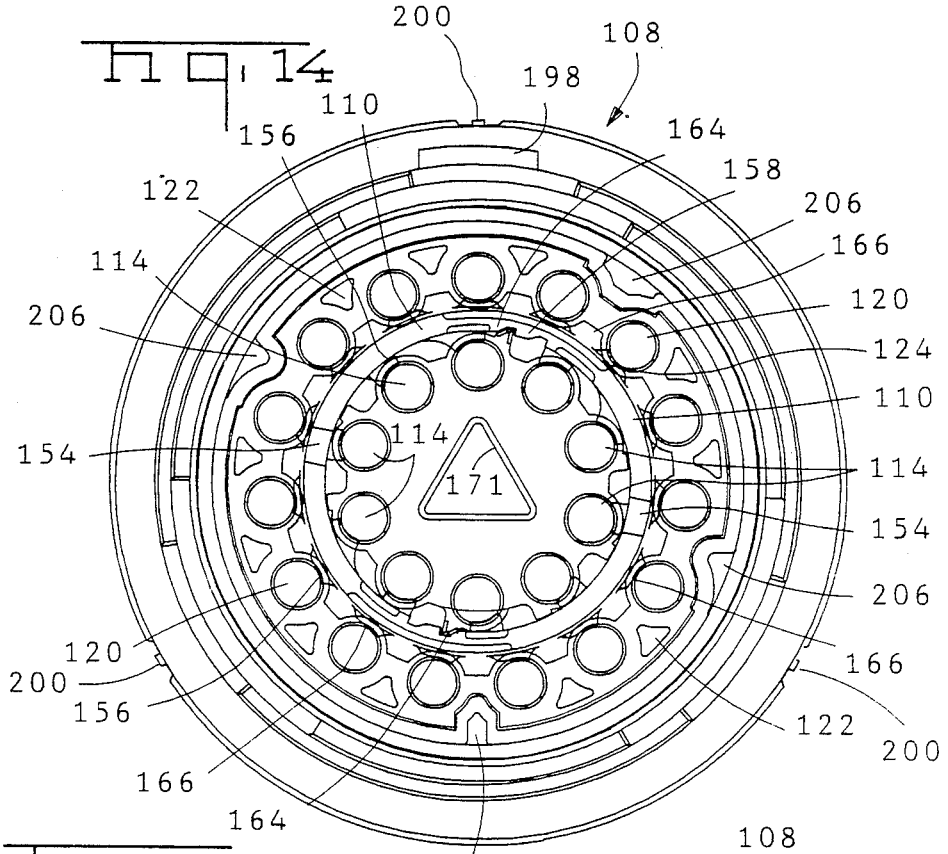
FIG. 14 is a full end view of the pin housing taken on the lines 14—14 of FIG. 16, but in which electrical pin terminals shown in FIG. 16 are omitted.
Figure 14A:
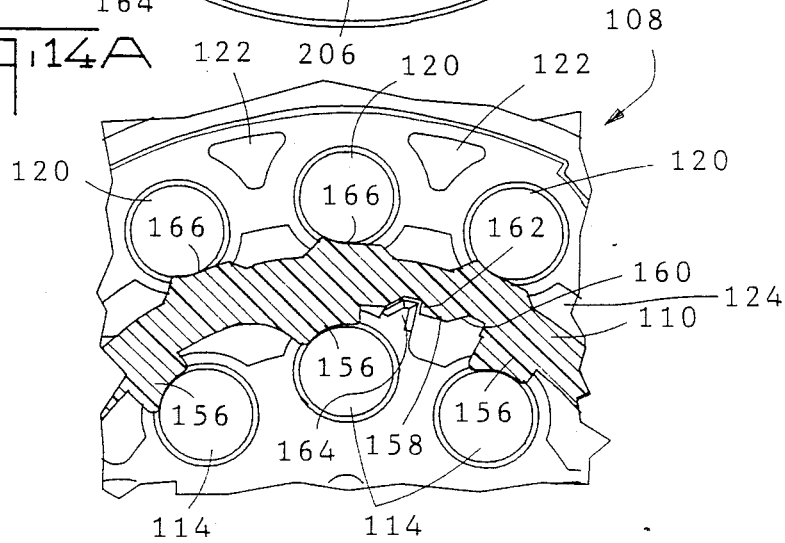
FIG. 14*a* is an enlarged fragmentary view taken on the lines 14*a*—14*a* of FIG. 16, but in which the pin terminals shown in FIG. 16 ar omitted.

Each terminal retainer 104 and 110 comprises an annular body 148 in the form of an open ended, circular cross-section tube having a leading end 150 and a trailing end 152 and having peripheral through slots 153 to enhance the resilience of the body 148. The trailing end 152 is formed with a pair of opposed slots 154, both of which are seen in FIG. 14, for receiving a tool blade (not shown). Near its leading end 150, the terminal retainer is formed with a ring of ten radially inwardly directed terminal retaining members 156 extending about the internal periphery of the body 148, and near its trailing end 152, with a pair of opposed, radially inwardly directed, teeth 158 each having, as best seen in FIGS. 13*a* and 14*a*, an inclined cam surface 160 on one side and a radially extending shoulder 162 on its opposite side. The inner wall 163 of the recess 124 is formed with a pair of diametrically opposed resilient spurs 164 each for cooperation with a respective tooth 158 as described below. Also, proximate to its leading end 150, each body 148 has a ring of fifteen outwardly directed terminal retaining members 166, opposite to the terminal retaining members 156.

As so far described, the housings 102 and 108 are similar and those parts thereof which are dissimilar to one another will now be described, firstly in respect of the pin housing 108. As best seen in, FIG. 7, the forward external peripheral wall 168 of the housing 108 is surrounded by a hood 170 which projects forwardly of the mating face 118 and is formed with an external triple screw thread 172 terminating in an offset portion 174. The hood 170 has a frusto-conical forward edge 175. A triangular cross-section plug 171 also projects forwardly from the mating face 118. Adjacent to the screw thread 172, the rearward external periphery 176 of the housing 108 is formed with three threads 178 following each other about the periphery 176, and each having an entry end 180 having an open side 182 adjoining the screw thread 172. Proximate to end 184 of each thread 178, opposite to its entry end 180, the floor of each thread 178 is formed with a ramp 186 which is inclined outwardly of the thread 178 in the direction of its end 184. Between the end 184 and the ramp 186, ramp 186 merges with further ramp 188, at an apex 190, the ramp 188 being inclined inwardly of the thread 178, the thread 178 deepening abruptly, between the ramp 188 and the end 184. Between threads 178 and the terminal receiving face 116, the outer peripheral wall 176 of the housing 108 is formed with a panel mounting flange 196 which extends about the whole periphery of the wall 176. Between the flange 196 and the threads 178, the wall 176 is formed with stop 198 parallel with the flange 196 but extending only about a short portion of the periphery of the wall 176 as best seen in FIGS. 13 and 14. Guide grooves 199 are formed in the wall 176 between an annular groove 197 therein and the threads 178, and follow one another about the periphery of the wall 176. The flange 196 is surmounted by three constantly spaced indicator pips 200, the purpose of which is explained below. There projects from the terminal receiving face 116, a skirt 202, the outer periphery of which is formed with finger grips 204. The internal wall of the hood 170 is formed with keys 206 of different cross sectional shapes distributed about its periphery, and which extend into grooves 208 in the peripheral wall 168, these being shown in FIGS. 13 and 14.

As shown in FIG. 6, the panel mounting ring 112 has a leading end 208 and a trailing end 210. It is formed at its end 210 with series of internally projecting guide ribs 212 distributed about the internal periphery of the ring 112, each for reception in a respective guide groove 199 in the wall 176 of the housing 108. Each thread 216 has a central transverse groove 217. The internal periphery of the ring 112 is also formed, intermediate the ends 208 and 210, with three radially inwardly projecting threads 216 which are inclined with respect to the axis of the ring 112, each for reception in a respective thread 178 of the housing 108. At its end 208, the ring 112 is formed with a series of internally projecting flanges 218 for engagement with the outer surfaces of the forward walls of the threads 178. Proximate to its leading end 208 the ring 112 has an external, outwardly projecting, panel engaging, peripheral rim 220 and external finger grips 222 between the rim 220 and the end 210. The ring 112 is assembled to the housing 108 with its end 208 leading, to position each thread 216 in a corresponding thread 178, whereafter the ring 112 is rotated, until the central groove 217 of each rib 216 snaps into engagement with the apex 190 in the corresponding thread 178 and each rib 212 engages in a respective groove 199. The flanges 218 engage against said forward walls of the threads 178, the rim 220 engaging the flange 198. The ring 112 is thereby fixed to the housing 108. In order to secure the housing 108 to a panel (not shown), the housing 108 is inserted through a circular hole in the panel, with the hood 170 leading, until the flange 196 butts against the margin of the hole. The ring 112 is then mounted to the housing 108 as described above so that the margin of the panel is trapped between flange 196 and the rim 220 of the ring 112. The snap engagement of the apices 190 in the grooves 217 indicates audibly that the ring 112 has properly been secured to the housing 108.

The terminal retainer 100 is mounted to the housing 108 by inserting it with its end 150 leading, into the recess 124 so that the terminal retaining members 156 and 166 lie in the opening 126 which, as mentioned above, intersects all of the cavities 114 and 120, with each spur 164 engaging the cam surface side 160 of a respective tooth 158 as best seen in FIG. 13*a*. In this angular position of the terminal retainer 110, which is its terminal insertion angular position, the terminal retaining members 156 lie between the cavities 114 of the inner ring of cavities, and the terminal retaining members 166 lie between the cavities 120 of the outer ring of cavities. Thus, a terminal 136 can be inserted into each cavity 114 and 120 as shown in FIG. 15 with the crimping ferrule 132 and the sealing grommet 134 of the terminal in the part 130 of the cavity, the abutment flange 137 engaging the shoulder 139 in the cavity and the latching tongue 146 of the terminal engaged with the shoulder 144 so that the terminal is latched in position in the cavity, although it could back out therefrom against the action of the tongue 146, which is not very robust, for example under the influence of vibration, or if the lead L to which the ferrule 136 is crimped, should be unduly tensioned. The terminal retainer 110 is then rotated by means of a tool blade engaged in the notches 154, in a clockwise sense, as seen in FIGS. 13 and 13*a* so that each tooth 158 on the terminal retainer 10 rides over the respective spur 164, assisted by the cam surface 160 of the tooth 158, to lodge against the shoulder 162 on the other side of the tooth 158 as best seen in FIG. 14*a*. The terminal retainer 10 is then in its terminal locking position, in which as best seen in FIGS. 14*a* and 16, the terminal retaining members 156 intersect the cavities 114 and the terminal retaining members 166 intersect the cavities 120; so that the members 156 overlie the abutment flanges 137 of the terminals in the cavities 114 and the members 166 overlie the abutment flanges 137 of the terminals in the cavities 120. Each terminal is accordingly locked in its cavity between the shoulder 139 therein and respective terminal retaining member so that it cannot back out from its cavity under any circumstances.

Figure 8:
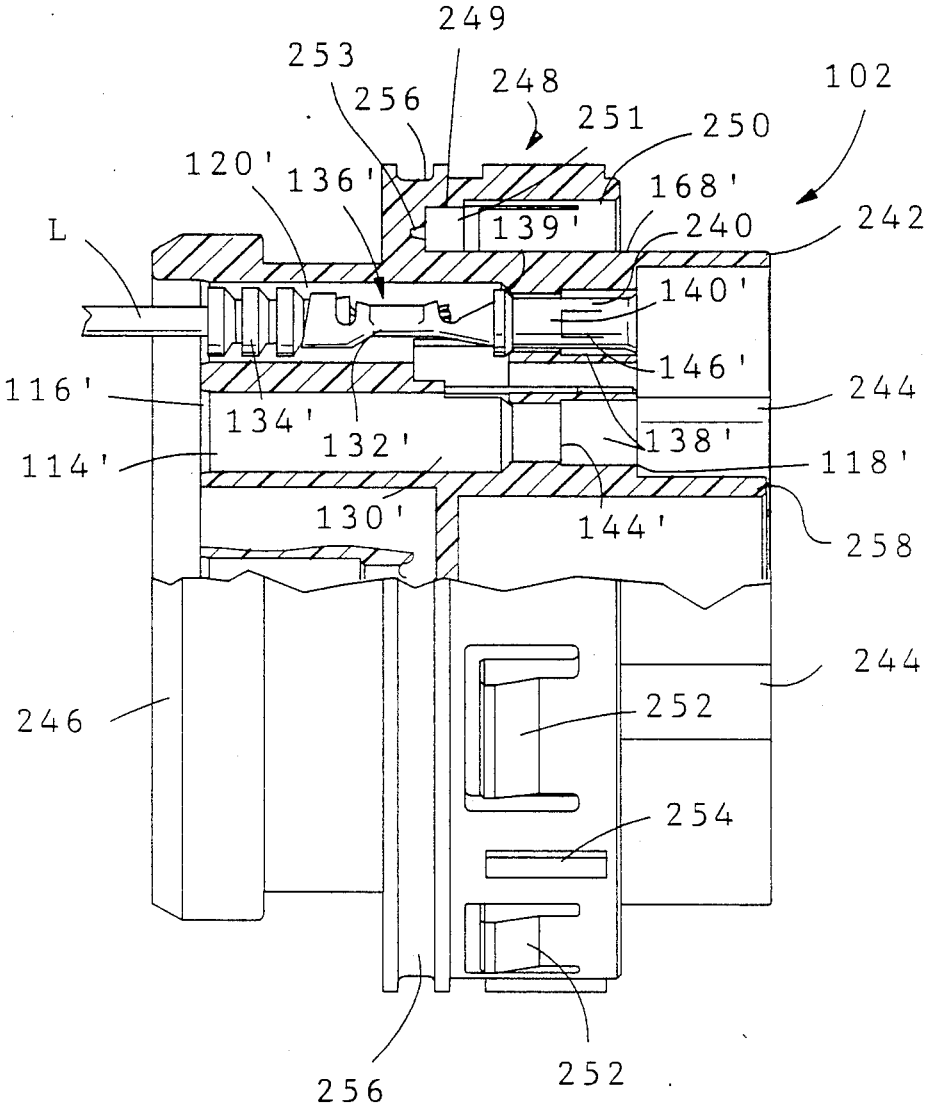
FIG. 8 is an enlarged view of the socket connector housing as shown in FIG. 6 but illustrating an electrical socket terminal disposed in a terminal receiving cavity of the housing.
Figure 9:
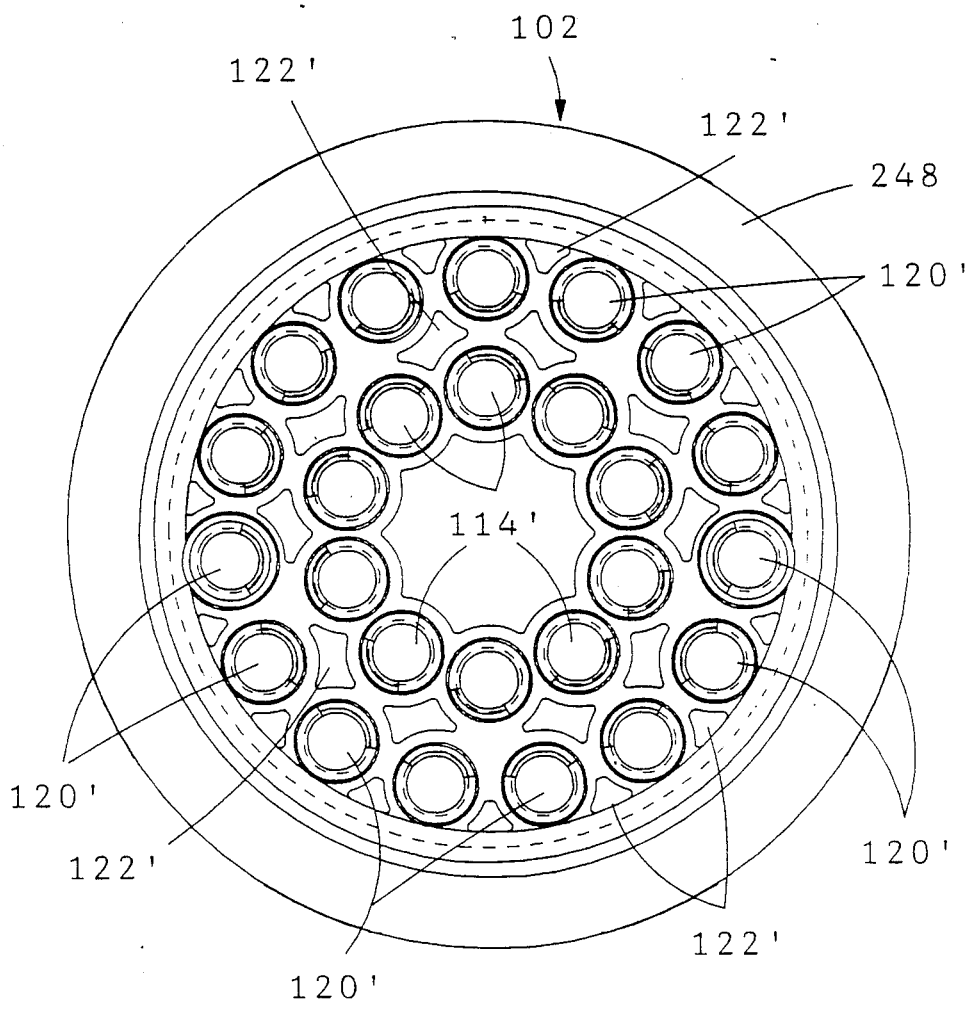
FIGS. 9 to 12 are enlarged end views taken on the lines 9—9, 10—10, 11—11, and 12—12, respectively, of FIG. 6.
Figure 10:
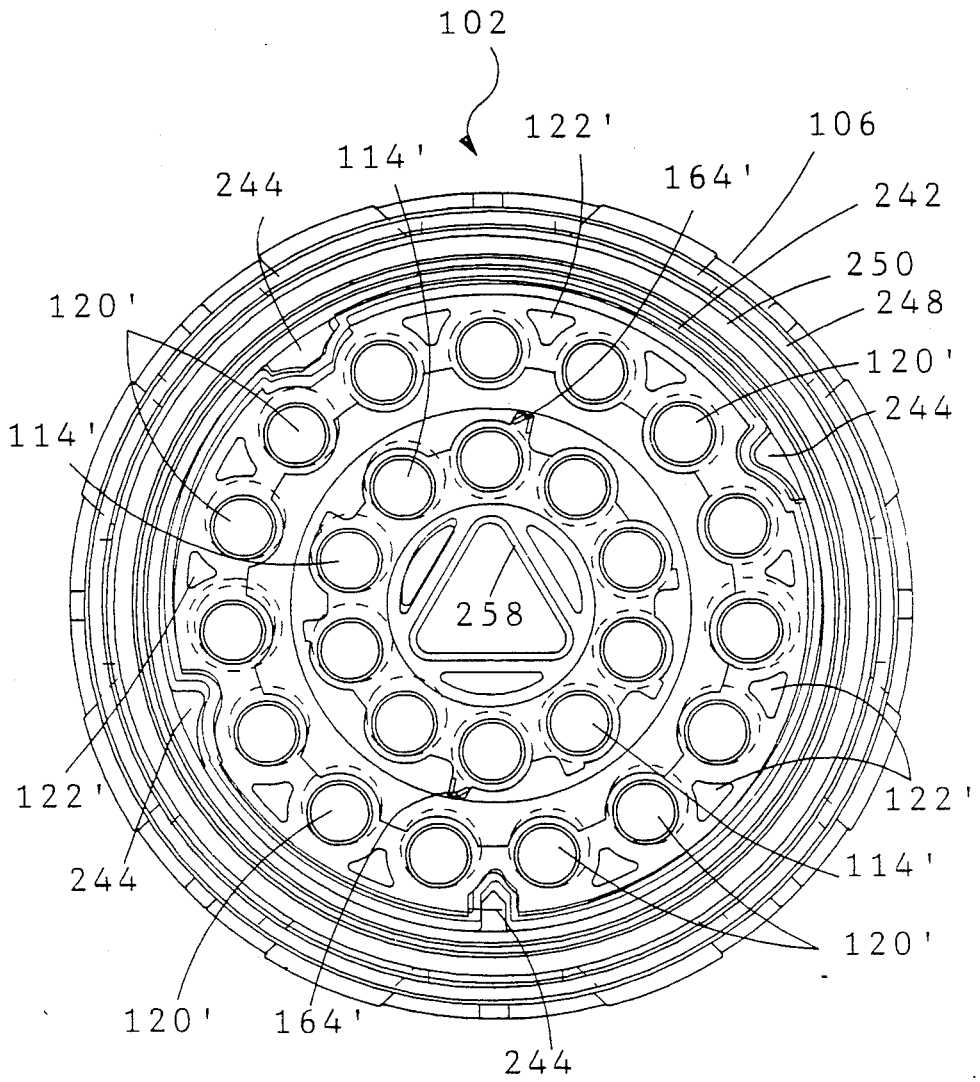

The housing 102 will now be described in so far as it differs from the housing 108. As shown in FIG. 8 the cavities 114′ and 120′ of the housing 102 are dimensioned to receive terminals 136′ (one of which is shown in FIG. 8) which differ from the terminals 136 in that instead of having mating portions in the form of electrical pins they have mating portions 240 in the form of sockets for the pins 142. The remaining parts of the terminals 136′ are substantially identical to those of the terminals 136. The free ends of the sockets 240 are substantially flush with the mating face 118′ of the housing 102. There projects from the face 118′ a hood 242 formed with external keyways 244, best seen in FIG. 10, each dimensioned to receive a respective key 206 in the hood 170 of the housing 108. These keyways 244 also extend peripherally over the wall 168′ of the housing 102. There projects from the terminal receiving face 116′ of the housing 102, a skirt 246 and there extends from the wall 168′, a latching ring 248 surrounding the wall 168′ and defining in cooperation therewith an annular socket 250, as best seen in FIG. 8. The socket 250 has an inner part 249 receiving a sealing ring 251 and which terminates in a reduced cross-section, frustoconical cross-section, annular recess 253. The ring 248 is formed with latch arms 252 distributed about its external periphery and having free ends directed towards the face 116′, that is to say rearwardly of the housing 102. Between each adjacent pair of latch arms 252 is an axial rib 254. The ring 248 is formed with an external peripheral groove 256. There projects forwardly from the face 118′ of the housing 102 a triangular cross-section receptacle 258 for mating with the triangular cross-section plug 171 of the housing 108.

As best seen in FIG. 6, the coupling ring 106 has a leading end 260 and a trailing end 262. Towards the end 262, the ring 106 is formed with three radially inwardly projecting studs 264 (only one of which is shown in FIG. 6) for meshing with the thread 172 of the housing 108, and between each pair of adjacent studs 264, with two circumferentially spaced ribs 266 extending axially of the ring 106. Towards its end 260, the ring 106 is formed with a series of internally projecting circumferential ribs 268. The external periphery of the ring 106 is provided with finger grips 270. Between each of three constantly spaced ribs 270 is an axially extending indicator arrow 272 for co-operation with a pip 200 on the flange 196 of the housing 108, as described below. The ring 106 is assembled to the housing 102, with its end 260 leading so that the ribs 268 depress the latch arms 252 on the ring 248 of the housing 102, and pass over them so that the ribs 268 slidably engage in the groove 256 of the ring 248, the arms 252 resiling thereafter, so that the ring 106 is secured to the ring 102, being freely rotatable thereabout. Ring 106 is prevented from backing off from the ring 102 by engagement of the free end of the ring 248 with the studs 264 and ribs 266.

The terminal retainer 104 is assembled to the housing 202 in the manner described above with reference to the terminal retainer 110 and the housing 108 so that the terminal retainer 104 is in its terminal insertion angular position when so assembled.

With the ring 106 and the terminal retainer 104 assembled to the housing 102 as described above and with the terminal retainer 110, only, assembled to the housing 108, the terminals 136' are inserted into the cavities 114', 120' of the housing 102 to be latched therein by means of their latching lances 246' and the terminals 136 are inserted into the cavities 114 and 120 of the housing 108 similarly to be latched therein. The housing 108 is then inserted into the circular hole in the panel with its hood 170 leading, and the ring 112 is assembled to the housing 108 to secure it firmly to the panel in the manner described above. The terminal retainers 104 and 110 are then rotated to their terminal locking angular positions by means of the tool mentioned above so that the terminals cannot back out from their cavities, as described above.

In order to mate the housings 102 and 108 which have been so assembled, the keys 206 of the hood 170 are slidably engaged with the respective keyways 244 of the hood 242, so that the hood 242 is received in the hood 170 and the coupling ring 106 is rotated so that the studs 264 thereof mesh with the screw threads 172 of the hood 170 whereby the housings are drawn together so that the ring 112 is received in the ring 106 with the frusto-conical edge 175 of hood 170 extending into the annular socket 250 defined between the ring 248 and the wall 168' of the housing 102 and the leading side of the flange 220 engaging the end 262 of the ring 106. Said edge 175 compresses the sealing ring 251 so that it fills the recess 253, thereby enhancing the sealing between the housings 102 and 108. As the flange 220 engages the end 262, each of the studs 264 engage with a snap action in the offset portion 174 of the respective thread 172, thereby indicating audibly that the housings 102 and 108 have been fully mated so that each pin 142 is properly received in a respective socket 240. The fully mated condition of the housings is also indicated by coincidence between each pip 200 on the flange 196 of the housing 108 and a respective arrow 272 on the coupling ring 106. Where the panel is of small extent, being for example an angle bracket in a motor vehicle, the pips 200 and the arrows 272 will be readily visible.

Advantages of arranging the terminal retainers interiorally of the housings, are that the outer peripheral walls thereof are free to receive the various means for coupling the two housings in the manner described above, that the housings may have two rings of terminal receiving cavities and that external sealing rings may be used with the housings.

We claim:

1. An electrical connector insulating housing defining a series of spaced terminal receiving cavities arranged in a ring about a longitudinal axis of the housing, the housing receiving a terminal retainer for angular displacement about said longitudinal axis between a first angular position to allow electrical terminals to be inserted into the cavities and a second angular position to overlie abutments on the terminals when they have been inserted into the cavities, to lock the terminals therein; characterized in that the terminal retainer is annular and surrounds the ring of cavities, the terminal retainer having radially inwardly directed terminal retaining members which intersect the cavities in the second angular position of the terminal retainer to overlie said abutments to lock the terminals in their cavities.

2. A housing according to claim 1, characterized in that the terminal retainer is received in a hood projecting from the housing, the cavities being defined by individual tubular walls cooperating with the hood to provide a guideway receiving and captivating the terminal retainer, each cavity communicating with the guideway by way of an opening for receiving the respective terminal retaining member in the second angular position of the terminal retainer.

3. A housing according to claim 2, characterized in that in the first angular position of the terminal retainer, the terminal retaining members lie between said tubular walls, an annular bead projecting radially inwardly of the terminal retainer engaging a shoulder in each tubular wall and an end of the terminal retainer engaging a shoulder defined by the housing to guide the terminal retainer between said angular positions.

4. A housing according to claim 1, characterized in that the housing defines a series of spaced further terminal receiving cavities surrounding said ring of cavities, the terminal retainer being disposed between said further cavities and the cavities of said ring of cavities and having outwardly directed terminal retaining further members which intersect said further cavities in the second position of the terminal retainer to overlie abutments on further terminals when they have been inserted into the further cavities, to lock the further terminals therein.

5. A housing according to claim 4, characterized in that the housing defines an annular recess between said ring of cavities and said further cavities, said recess receiving the terminal retainer, the terminal retainer having a first latch member cooperating with a second latch member on a wall of the recess, to lock the terminal retainer in its first and second angular positions.

6. A housing according to claim 5, characterized in that the first latch member comprises a radially inwardly directed tooth on the terminal retainer, the second latch member comprising a resilient spur projecting radially inwardly from the radially inner wall of said recess, and being engageable with a cam surface on one side of the tooth in the first angular position of the terminal retainer and with a shoulder on the opposite side of the tooth in the second angular position of the terminal retainer.

7. A housing according to claim 4, characterized in that an external peripheral wall of the housing is formed with keying means for cooperation with complimentary keying means of a mating electrical connector housing, the external peripheral wall being surrounded by a latching ring cooperating therewith to define an annular socket for receiving a hood on the mating housing, the latching ring being formed with a series of latch arms spaced from one another about the external periphery of the latching ring and being latched against internal projections of a coupling ring for meshing with an external screw thread on said hood.

8. A housing according to claim 4, characterized in that an external peripheral wall of the housing is surrounded by a hood projecting beyond a mating face of the housing and being formed with a first screw thread for meshing with internal studs of a coupling ring of a mating electrical connector housing, an external peripheral panel mounting flange projecting from the external peripheral wall between the first screw thread and a terminal receiving face of the housing, a second screw thread formed in the external peripheral wall between said flange and said first screw thread being meshed with a panel mounting ring extending about said peripheral wall parallel to said panel mounting flange, said first screw thread terminating in offset portions for snap engagement with said studs, and said second screw thread terminating in means for snap engagement with an internal thread of the flange mounting ring.

9. An electrical connector comprising an insulating housing defining a series of spaced terminal receiving cavities arranged in a ring about an axis of the housing and opening into opposite terminal receiving and mating end faces thereof, an elongate electrical terminal in each cavity having an electrical lead terminated thereto at one end of the terminal proximate to said terminal receiving face, the terminal having a mating portion at its other end, and intermediate the mating portion and the lead an abutment extending radially of said axis, the housing receiving a terminal retainer for angular displacement about said axis between a first angular position out of register with the abutments and a second angular position in overlaying relationship therewith to prevent withdrawal of the terminals from the cavities by way of the terminal receiving face characterized in that the terminal retainer is annular and surrounds the ring of cavities, the terminal retainer having radially inwardly directed terminal retaining members which intersect the cavities in the second angular position of the terminal retainer to overlie the abutments, so that each abutment projects between the respective terminal retaining member and a stop in the housing between the terminal retaining member and said mating face each electrical lead being surrounded by a sealing grommet engaging the wall of the respective cavity in sealing tight relationship therewith proximate to the terminal receiving face.

10. A connector according to claim 9, characterized in that the housing defines a series of spaced further terminal receiving cavities surrounding the ring of cavities, the terminal retainer being disposed in an annular recess formed in the housing between the ring of cavities and the further cavities and opening into the mating face, the terminal retainer having outwardly directed terminal retaining further members which intersect said further cavities in the second position of the terminal retainer to overlie abutments on further terminals when they have been inserted into the further cavities to lock the further terminals therein, the annular recess communicating with an annular opening in a wall of the housing which separates the cavities of the ring of cavities from said further cavities, the annular opening communicating with all of the cavities and containing the terminal retaining members for movement with the terminal retainer between its first and second positions.

* * * * *